US006632473B2

(12) United States Patent
Kaneko et al.

(10) Patent No.: US 6,632,473 B2
(45) Date of Patent: Oct. 14, 2003

(54) METHOD OF PRODUCING FERRITE THIN FILM

(75) Inventors: Shoji Kaneko, Hamamatsu (JP); Akio Takayama, Iwata-gun (JP)

(73) Assignee: Minebea Co. Ltd., Nagano-Ken (JP)

( * ) Notice: Subject to any disclaimer, the term of this patent is extended or adjusted under 35 U.S.C. 154(b) by 3 days.

(21) Appl. No.: 10/102,976

(22) Filed: Mar. 22, 2002

(65) Prior Publication Data

US 2002/0182324 A1 Dec. 5, 2002

(30) Foreign Application Priority Data

Mar. 30, 2001 (JP) ..... 2001-100927
Mar. 20, 2002 (JP) ..... 2002-078779

(51) Int. Cl.[7] ..... B05D 5/12

(52) U.S. Cl. ..... 427/129; 427/128; 427/422; 427/427

(58) Field of Search ..... 427/128, 129, 427/422, 427

(56) References Cited

U.S. PATENT DOCUMENTS 4,837,046 A * 6/1989 Oishi et al. ..... 427/38
5,384,158 A * 1/1995 Chin et al. ..... 427/129

FOREIGN PATENT DOCUMENTS

JP A 8-138934 5/1996
JP A 8-335514 12/1996

* cited by examiner

*Primary Examiner*—Bernard Pianalto

(57) ABSTRACT

A raw material mixed solution containing nitrate or alkoxide of metal that constitutes a ferrite is sprayed from an atomizer by means of a carrier gas such as compressed air onto a substrate mounted on a hot plate and heated to a predetermined temperature. The method enables a thin film having a desired thickness to be formed by a simple apparatus in a short time without sacrificing good soft magnetism of a ferrite, thereby greatly contributing to downsizing and weight reduction of electronic devices.

19 Claims, 10 Drawing Sheets

METHOD OF PRODUCING FERRITE THIN FILM

BACKGROUND OF THE INVENTION

1. Field of the Invention

The present invention relates to a method of producing a soft magnetic material, in particular, a ferrite thin film, for use in a transformer, an inductor, an anti-EMI component and the like.

2. Description of the Related Art

In recent years, along with an increasing adoption of multi-media due to a dramatic progress in semiconductor integrated circuit technology, mobile devices such as a cellular phone, a notebook-type personal computer and an electronic pocketbook have been astonishingly popularized. These mobile devices use a battery as a driving power source. Since the battery must drive various types of devices, a single voltage of the battery is stepped up or down by use of a DC—DC converter so as to be supplied to each device. On the other hand, with performance enhancement, downsizing and weight reduction of the mobile devices being advanced, downsizing and weight reduction of the DC—DC converter are also increasingly demanded. To meet this demand, soft magnetic parts of thin film type for a transformer and an inductor for the DC—DC converter are under development.

Also, it is a recent trend that the frequency used for the transmission of signals of electronic devices is made higher and higher. As a result, it can happen that the electromagnetic energy generated by a device system travels through an electrical wire as a voltage or current fluctuation or propagates in space as an electromagnetic wave, causing reception difficulty or malfunction in other device systems. For this reason, device systems must emit as limited jamming waves as possible and must also be electromagnetically tolerant so as not to be disturbed by jamming waves from other device systems. Accordingly, anti-EMI components have been increasingly employed. And the anti-EMI components are also requested to be downsized and reduced in weight, which has been driving the components into thin film type.

Conventionally, for thin film magnetic parts used for the above-mentioned transformers, inductors, anti-EMI components and so forth, Ni—Fe based, Co—Zn—Nb based metal magnetic thin films have been generally used because they can be relatively readily formed by a sputtering method. However, the metal magnetic thin films usually have to have a large inductance so they have to be formed relatively thick, for example, with a thickness of several micrometers ($\mu$m). A film with such a thickness has a high electrical conductivity and is apt to suffer eddy current loss in a high frequency domain, which causes an extreme deterioration in soft magnetic properties.

On the other hand, a ferrite is known as a soft magnetic material that has a low electrical conductivity and exhibits an excellent soft magnetism even in a high frequency domain. The ferrite used as a thin film magnetic part for the above-mentioned transformer, inductor or the like will realize a small size and lightweight electronic device that can function satisfactorily in a high frequency domain.

However, there has been no firm technology established for film formation of a ferrite and hence various methods have been practiced by trial and error. The methods include a general purpose method such as a sputtering method, an evaporation method and a plating method, and also include a powder beam method in which a high flow rate gas is used as a carrier gas for spraying ferrite fine particles onto a substrate, a sol/gel method in which sol/gel is applied by spin coating or dipping, a plasma MOCVD method in which a raw material gas is converted into plasma thereby laminating a ferrite on a substrate (Japanese Patent Laid-open Nos. Hei 08-138934 and Hei 08-335514, etc.) and so forth.

In the above-mentioned sputtering method or evaporation method, the film formation rate is low. Accordingly, it takes a long time to produce a thin film with relatively large thick such as several micrometers ($\mu$m), which prohibits a desired productivity. In addition, an expensive equipment is required for the method inevitably pushing up production costs.

Although the above-mentioned plating method gives a high film formation rate, the composition of the thin film or the abundance ratio between divalent iron ion (ferrous ion) and trivalent iron ion (ferric ion) changes even with a slightest fluctuation in current density. As a result, coercive field (Hc) exceeds 1 kA/m making it very difficult to obtain good soft magnetism in a stable manner.

In the above-mentioned powder beam method, a ferrite thin film with good soft magnetism can be produced at a relatively high speed. However, the thin film obtained has a rough surface and in addition a severe damage is given to the substrate.

In the above-mentioned sol/gel method, while it is difficult to obtain a film thickness of 1 $\mu$m or more by spin coating, the film thickness is poorly distributed by dipping. In either case, it is difficult to obtain a thin film with a desired thickness in a stable manner. The sol/gel method requires annealing at 600° C. or higher for crystallization, which inevitably increases the number of steps and energy consumption thereby pushing up production costs.

Furthermore, the above-mentioned plasma MOCVD method requires apparatuses such as a reduced pressure reaction chamber, a vaporizer, and a high frequency power source, incurring a high cost of equipment.

SUMMARY OF THE INVENTION

The present invention has been made in consideration of the above technical background, and an object of the present invention is to provide a method of producing a ferrite thin film that, by a simple apparatus, can efficiently form a thin film having a desired thickness without sacrificing excellent soft magnetism of ferrite thereby greatly contributing to downsizing and weight reduction of electronic devices.

To solve the above-described problems, the present invention provides a method of producing a ferrite thin film, in which a raw material mixed solution containing nitrate or alkoxide of metal that constitutes a ferrite is sprayed by means of a carrier gas onto a heated substrate.

The present invention utilizes a so-called spray pyrolysis deposition (SPD) method. In the SPD method, minute droplets containing a raw material compound (metal nitrate or metal alkoxide) on the substrate are condensed as the solvent vaporizes or gasifies, then pyrolysis deposition and chemical reaction of the raw material take place making a solid phase of the objective substance (ferrite) deposit on the substrate to form a thin film. The SPD method can be practiced in the air by a simple apparatus including an atomizer and does not require vacuum exhaust unlike the sputtering method, the evaporation method or the plasma MOCVD method. Accordingly, the expense relating to the equipment is reduced to a greater extent. In addition, the SPD method features simple operation and a low energy consumption. Also, a wide range of raw material can be selected and a ferrite film can be formed with various compositions. Moreover, a thin film with a large area can be formed.

In the present invention, the temperature of the substrate (hereinafter, sometimes referred to as "substrate temperature") is preferably set to 300 to 500° C. This is because the film formation process described above is critically influenced by the substrate temperature. Specifically, if the substrate temperature is too low, the above-mentioned pyrolysis deposition and chemical reaction take place insufficiently, while the solute is rapidly gasified and thermally decomposed to become powdery if the substrate temperature is too high. In either case, thin films having a good quality can be hardly formed in a stable manner.

In the present invention, the raw material mixed solution may be intermittently sprayed onto the substrate. This allows the substrate temperature to recover when the substrate mounted, for example, on a hot plate gets its temperature lowered temporarily due to the raw material mixed solution sprayed thereon. The substrate may have a heater built-in thereby constituting a self heat generating type. In this case, the substrate temperature can be kept constant by detecting the substrate temperature and feedback-controlling the heater based on the temperature detected. As a result, thin film formation by continuously spraying the raw material mixed solution is possible.

The substrate may be of a glass, ceramic, a non-magnetic metal and so forth. In the case where the substrate temperature is set to 350° C. or less, the substrate may be of a heat-resistant resin such as polyimide.

Furthermore, the carrier gas may be compressed nitrogen gas, oxygen gas, argon gas (inert gas) and so forth as well as compressed air.

The present invention does not limit the composition system (kind) of the ferrite to be produced but may be applied to formation of a thin film of a Zn ferrite, a Cu ferrite, a Ni—Zn ferrite, a Mn—Zn ferrite and so forth. Therefore, in embodying the present invention, the kind of metal nitrate or metal alkoxide to be contained in the above-mentioned raw material mixed solution may be selected appropriately depending on the composition system. Specifically, in case of producing a thin film of a Zn ferrite, a mixture of $Fe(NO_3)_3$ and $Zn(NO_3)_2$ is selected as the metal nitrate and a mixture of an Fe alkoxide and a Zn alkoxide is selected as the metal alkoxide. In case of producing a thin film of a Cu ferrite, a mixture of $Fe(NO_3)_3$ and $Cu(NO_3)_2$ is selected as the metal nitrate and a mixture of an Fe alkoxide and a Cu alkoxide is selected as the metal alkoxide. Further, in case of producing a thin film of a Ni—Zn ferrite, a mixture of $Fe(NO_9)_9$, $Zn(NO_3)_2$ and $Ni(NO_3)_2$ is selected as the metal nitrate and a mixture of an Fe alkoxide, a Zn alkoxide and a Ni alkoxide is selected as the metal alkoxide. Still further, in case of producing a thin film of an Mn—Zn ferrite, a mixture of $Fe(NO_3)_3$, $Zn(NO_3)_2$ and $Mn(NO_3)_2$ is selected as the metal nitrate and a mixture of an Fe alkoxide, a Zn alkoxide and a Mn alkoxide is selected as the metal alkoxide.

In the case where a Ni—Zn ferrite thin film is to be produced, the metal nitrate or metal alkoxide is preferably compounded such that ion concentrations of $(Fe)_2$, Zn and Ni in the ferrite thin film fall within the following ranges:

$$0.30 \leqq a \leqq 0.70,\ 0.14 \leqq b \leqq 0.45,\ \text{and}\ 0.08 \leqq c \leqq 0.38$$

where a, b and c are ion concentrations of $(Fe)_2$, Zn and Ni, respectively, and a+b+c=1.

Also, in the case where a Mn—Zn ferrite thin film is to be produced, the metal nitrates or metal alkoxide is preferably compounded such that ion concentrations of $(Fe)_2$, Zn and Mn in the ferrite thin film fall within the following ranges:

$$0.30 \leqq a \leqq 0.70,\ 0.15 \leqq b \leqq 0.38,\ \text{and}\ 0.10 \leqq c \leqq 0.55$$

where a, b and c are ion concentrations of $(Fe)_2$, Zn and Mn, respectively, and a+b+c=1.

BRIEF DESCRIPTION OF THE DRAWINGS

FIGS. 2I, 2II, 2III and 2IV illustrates a process of film formation by an SPD method;

FIGS. 3A, 3B, 3C and 3D illustrates an influence of a substrate temperature on droplets in the SPD method;

FIGS. 4A1, 4A2, 4A3 and 4A4 shows M—H curves of a Zn ferrite thin film of Example 1;

FIGS. 5B1, 5B2, 5B3 and 5B4 shows M—H curves of a Ni—Zn ferrite thin film of Example 2;

DETAILED DESCRIPTION OF THE PREFERRED EMBODIMENTS

Hereinafter, the present invention will be illustrated in detail by way of embodiments. However, the present invention should not be construed as being limited thereto.

Figure 1:
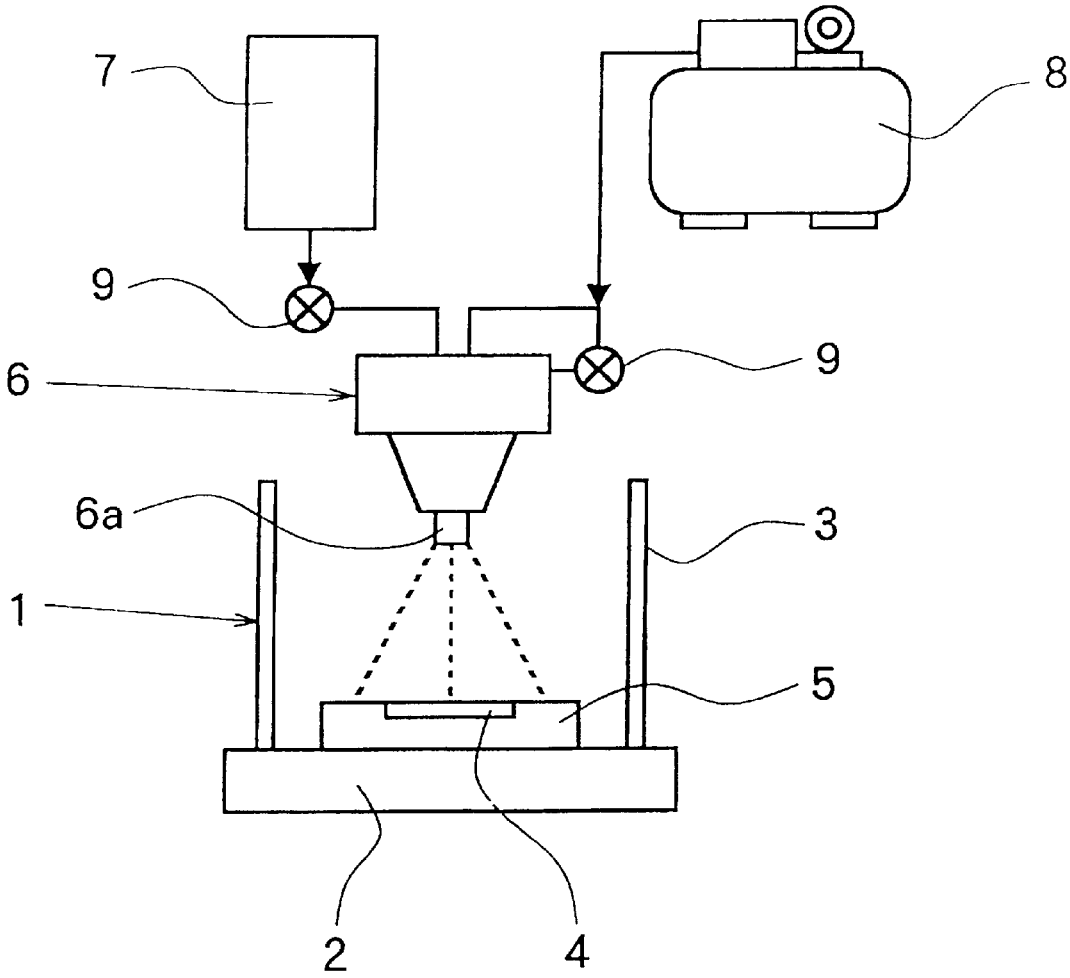
FIG. 1 shows a structure of a spray pyrolysis deposition (SPD) apparatus for carrying out a method of producing a ferrite thin film according to the present invention.

In FIG. 1, reference numeral 1 designates a spray tank. The spray tank 1 is of an open top structure comprising a hot plate 2 as a bottom plate having a built-in heater and a frame 3 arranged on the hot plate 2. On the hot plate 2, a holder 5 is mounted that holds a substrate 4 used in forming a ferrite thin film. Above the spray tank 1, an atomizer 6 having a spray nozzle 6*a* at a lower end thereof is movably arranged so as to go up and down. A solution tank 7 that contains a raw material mixed solution and an air compressor 8 that generates compressed air as a carrier gas are connected to the atomizer 6 through respective pipes in parallel. The pipes have respective regulators 9 and 9 which predetermine flow rates of the raw material mixed solution and the compressed air to be supplied to the atomizer 6. The solution tank 7 and the air compressor 8 are provided with respective electromagnetic valves (not shown) which are opened and closed by means of a controller (not shown).

Figure 2:
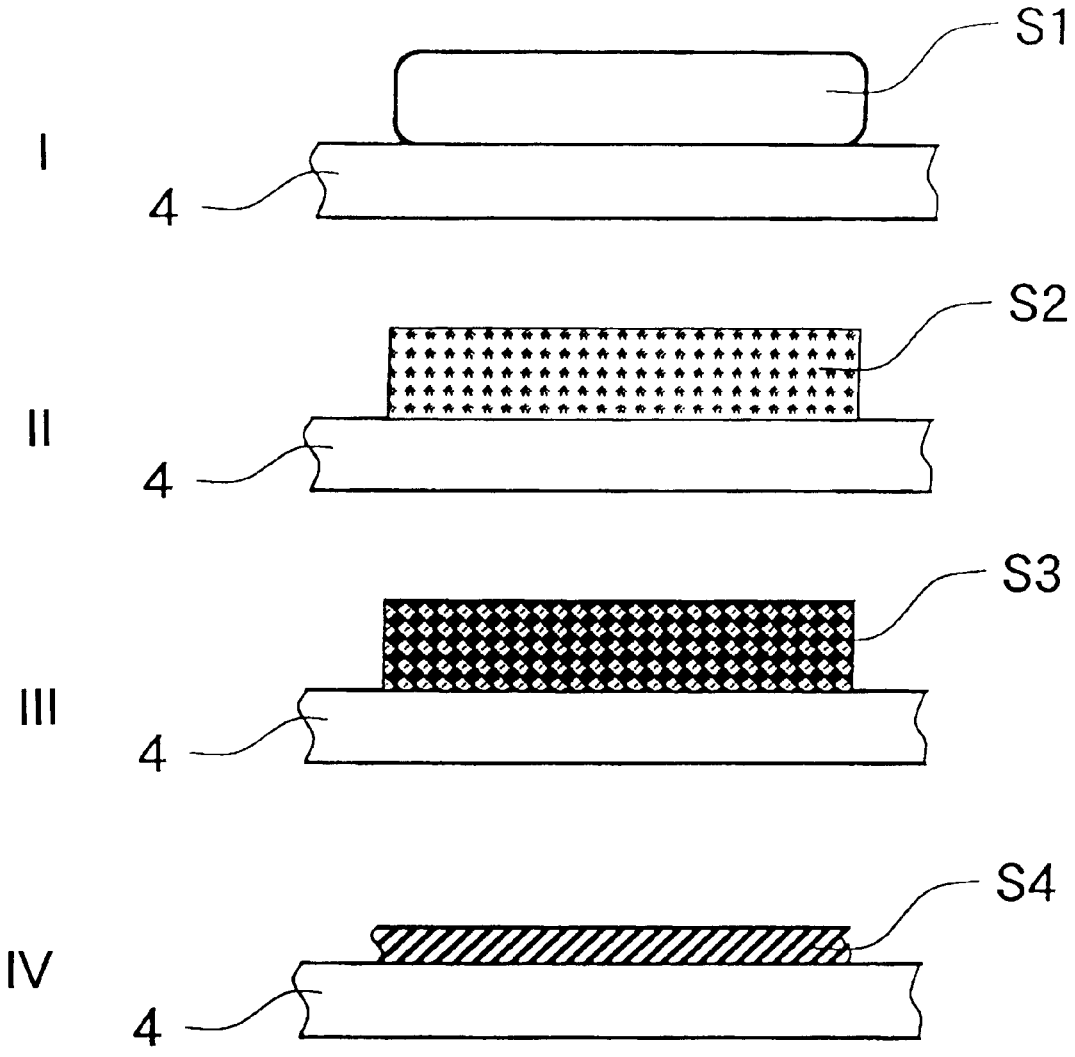
Figure 3:
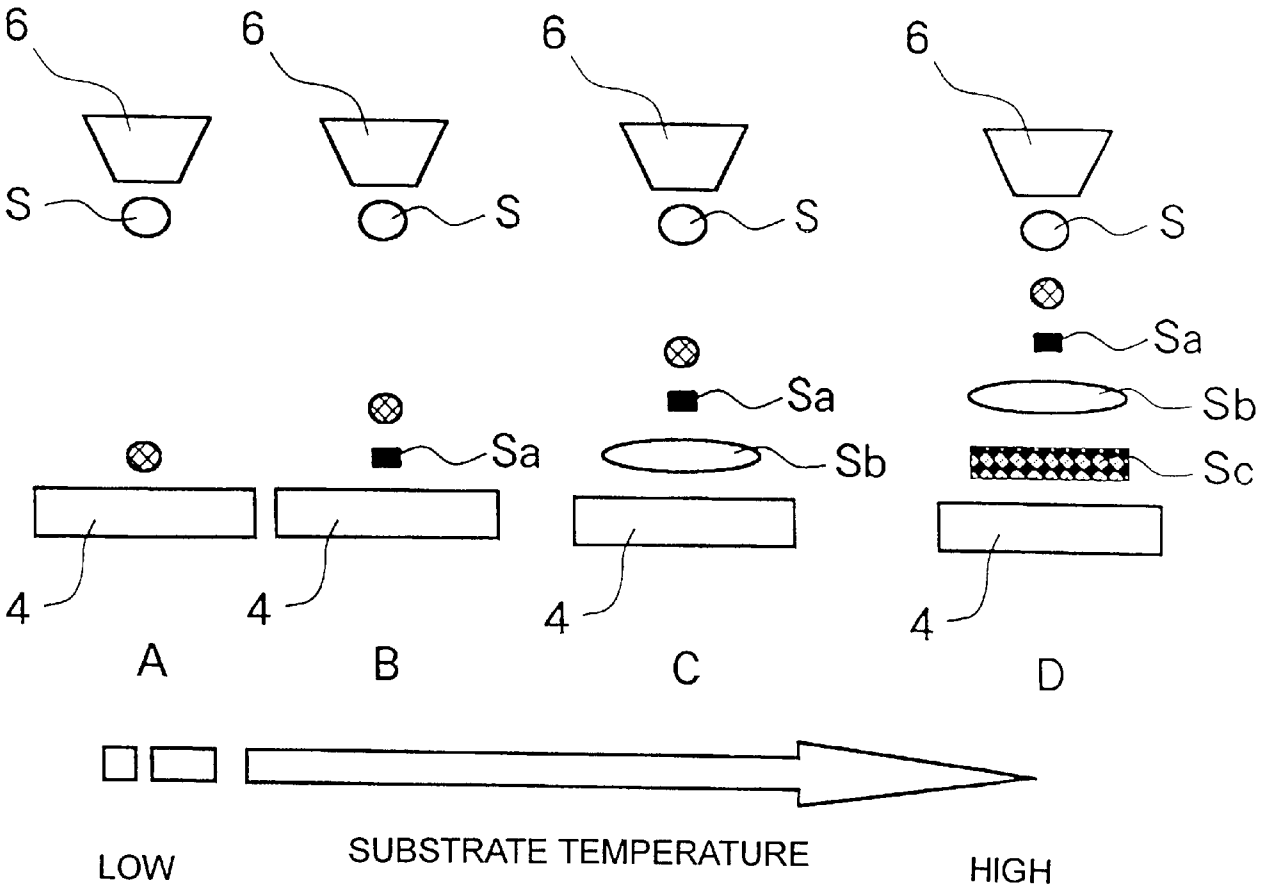

A raw material mixed solution obtained by mixing nitrate or alkoxide of metal constituting an objective ferrite into a solvent is put in the solution tank 7. The "nitrate of metal" may be referred to as "metal nitrate" and the "alkoxide of metal" as "metal alkoxide". The substrate 4 together with the holder 5 is mounted on the hot plate 2 and is pre-heated to a predetermined temperature (300 to 500° C.). Then, the atomizer 6 is arranged so that the nozzle 6*a* is located at a predetermined distance from the substrate 4, and the electromagnetic valves (not shown) provided at the solution tank 7 and the air compressor 8, respectively, are opened, then the raw material mixed solution is sprayed from the atomizer 6 onto the substrate 4 and a thin film is formed on the substrate 4 according to a film formation process (FIGS. 2I, 2II, 2III and 2IV) explained hereinbelow.

Here, as a result of the raw material mixed solution sprayed onto the substrate 4, the temperature of the substrate 4 lowers slightly (5 to 10° C.). Accordingly, in the present embodiment, after the spraying for a certain time, the atomizer 6 is temporarily stopped until the temperature of the substrate 4 is recovered to the predetermined temperature. When the temperature of the substrate 4 is recovered, the atomizer 6 is restarted. This cycle is repeated prescribed times, thereby performing intermittent spraying. This is operated by opening and closing actions of the respective electromagnetic valves provided at the solution tank 7 and the air compressor 8 in accordance with a command from the controller (not shown). For example, one cycle set to consist of a spray time for 0.5 second and a stop time for 1 second is repeated 50 to 600 times. As a result, the temperature of the substrate 4 is maintained constant and a ferrite thin film having a predetermined thickness and exhibiting excellent soft magnetism is formed on the substrate 4.

In FIGS. 2I, 2II, 2III and 2IV, when a minute droplet S1 formed by spraying a raw material mixed solution and containing a raw material compound (metal nitrate or metal alkoxide) gets on the substrate 4 (I), a solvent in the minute droplet S1 is gasified/evaporated and the solute (raw material compound) is condensed and dried to undergo pyrolysis, so that a metal cluster S2 deposits on the substrate 4 (II). Then, as time passes, the metal cluster S2 undergoes chemical reaction and converts into a metal compound cluster S3 (III). Further, a solid phase of the objective substance (ferrite) deposits on the substrate 4, thus forming a thin film S4 (IV).

The conversion process of droplets in the SPD method is greatly influenced by the temperature of the substrate 4 as shown in FIGS. 3A, 3B, 3C and 3D When the substrate temperature is low (A), the droplet S sprayed from the atomizer 6 still contains the solvent at the time of getting on the substrate 4 although its size is reduced due to evaporation. Then, the solute, with the solvent completely evaporated, undergoes pyrolysis and chemical reaction and the thin film S4 is formed in accordance with the above-mentioned film formation process (FIGS. 2I, 2II, 2III and 2IV). When the temperature of the substrate 4 rises (B), the solvent is evaporated from the droplet S and the solute gets on the substrate 4 in a state of a liquid phase or a solid phase Sa. Accordingly, the pyrolysis and the chemical reaction on the substrate 4 take place unstably, making it difficult to form a thin film having a desired thickness and magnetic properties. When the temperature of the substrate 4 rises further (C), it happens that not only the solvent is evaporated from the droplet S but also the solute gets on the substrate 4 in a state of the solid phase Sa or a gas phase Sb, and the film formation proceeds in a similar mechanism to that of the CVD method. And, when the temperature of the substrate 4 rises still further (D), the solvent evaporates and the solute gasifies both rapidly and as a result the solid phase Sa or the gas phase Sb undergoes pyrolysis to form powder Sc, which deposits on the substrate 4, so that a thin film cannot be formed.

The present embodiment is intended to unfailingly and stably carry out film formation by the SPD method assuming the low temperature of the substrate 4 (A) as an optimal condition, where the desired effect can be achieved by setting the temperature of the substrate 4 to 300 to 500° C. as described above.

EXAMPLES

Hereinafter, the present invention is illustrated in detail by way of examples. However, the present invention should not be construed as being limited thereto.

Example 1

The SPD apparatus shown in FIG. 1 was used and a glass substrate (Corning #1737) as the substrate 4 was provided. The substrate 4 together with the holder 5 was mounted on the hot plate 2. The distance from the substrate 4 to the nuzzle 6*a* was set to 300 mm. Three kinds of raw material mixed solutions were provided which contained $Zn(NO_3)_2 \cdot 6H_2O$ and $Fe(NO_3)_3 \cdot 9H_2O$ as metal nitrate in a ratio of 0.02:0.04, 0.2:0.4 and 0.002:0.004, respectively, in terms of a raw material molar concentration. While keeping the substrate temperature to 400° C., each of the raw material mixed solutions was intermittently spayed onto the substrate 4 by means of compressed air of 0.01 MPa as a carrier gas in such a manner that a cycle consisting of a 0.5 second spray time and a 1 second stop time was repeated 10 to 800 times, and a Zn ferrite thin film having a composition of $ZnFe_2O_4$ was formed on the substrate 4.

Figure 4:
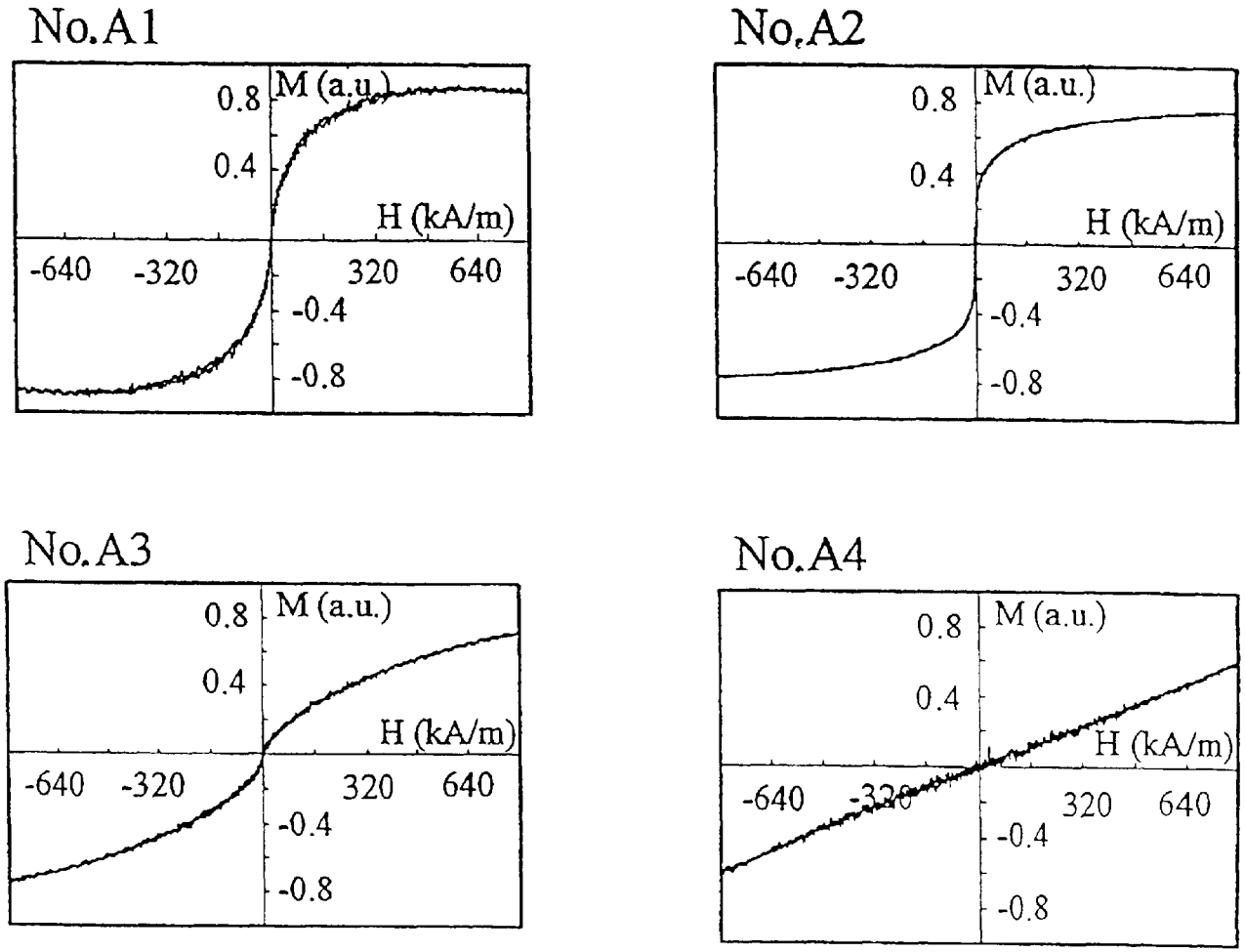
Figure 5:
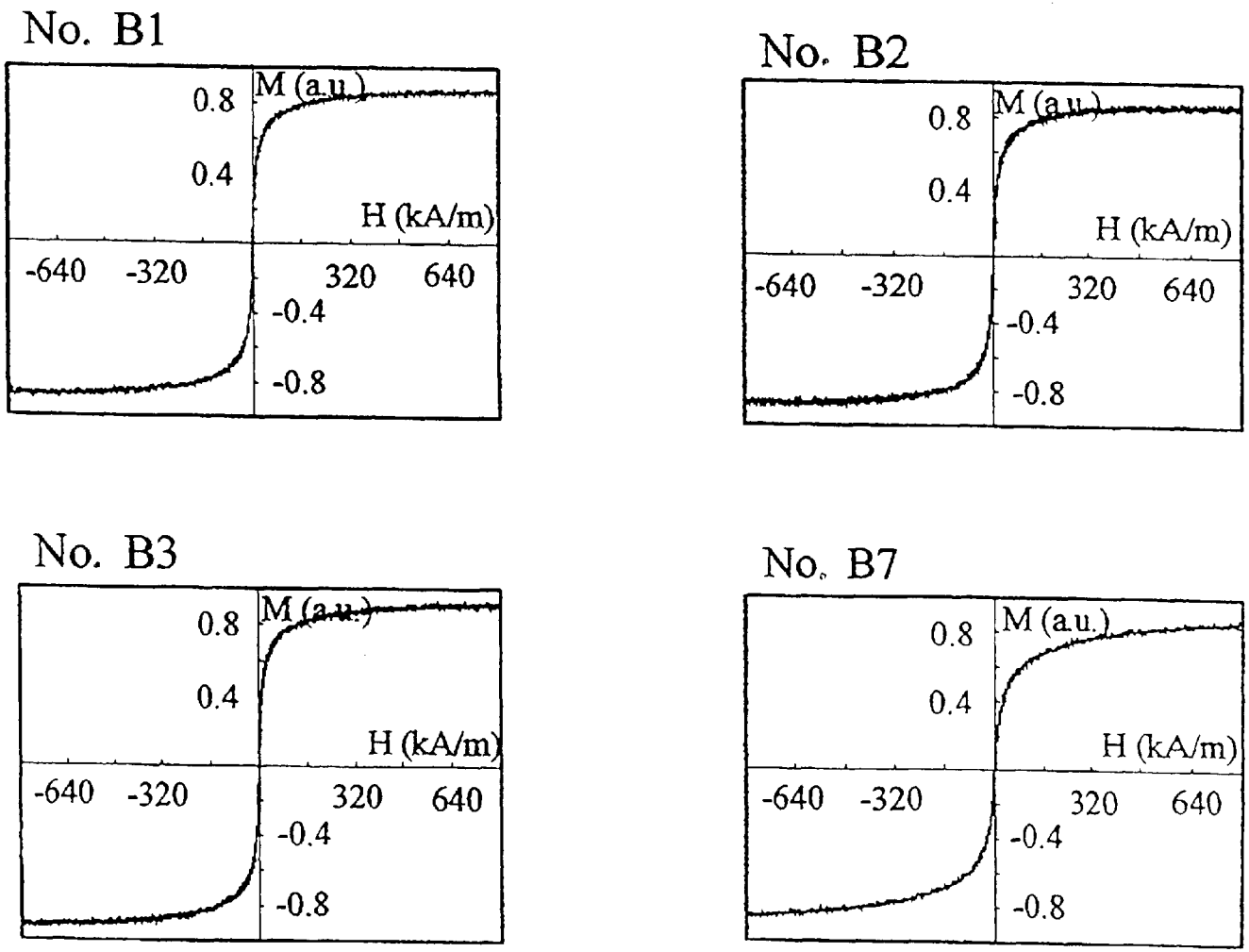

Samples A1 to A5 each having a thin film formed thereon as described above were measured on film thickness and subjected to tests on magnetic properties to obtain a B—H curve and a coercive field Hc (A/m). The results obtained are shown in FIG. 4 and Table 1. FIG. 4 shows a so-called M—H curve in which a residual magnetic flux B represented by the vertical axis of B—H curve is expressed in an arbitrary unit.

TABLE 1

| Sample No. | Molar Concentration of Raw Material $Zn(NO_3)_2$:$Fe(NO_3)_3$ | Number of Spraying (time) | Film Thickness ($\mu$m) | Coercive Field Hc (A/m) |
|---|---|---|---|---|
| A1 | 0.02:0.04 | 40 | 1.0 | 150 |
| A2 | 0.02:0.04 | 80 | 2.0 | 48 |
| A3 | 0.2:0.4 | 10 | 2.0 | 220 |
| A4 | 0.002:0.004 | 400 | 0.5 | Large |
| A5 | 0.002:0.004 | 800 | 1.0 | 1640 |

The results shown in FIGS. 4A1, 4A2, 4A3 and 4A4 and Table 1 indicate that samples A4 and A5 with a film formed by spraying the raw material mixed solution having its raw material molar concentrations of $Zn(NO_3)_2 \cdot 6H_2O$ and $Fe(NO_3)_3 \cdot 9H_2O$ set as low as 0.002:0.004 have almost no soft magnetism or considerably deteriorated soft magnetism. Samples A1, A2 and A3 obtained with the raw material molar concentrations set to 0.02:0.04 or 0.2:0.4 show a coercive field Hc of 220 A/m or less, which is sufficiently smaller than a general tolerance limit of 500 A/m. This means good soft magnetism with no or almost no hysteresis is obtained.

In this example, metal nitrate was used as the raw material mixed solution. However, metal alkoxide such as Zn—OR and Fe—OR (O; oxygen, R; alkyl group) can be used in place of the metal nitrate.

Example 2

The SPD apparatus shown in FIG. 1 was used and the distance from the glass substrate 4 to the nozzle 6*a* was set to 300 mm same as in Example 1. A raw material mixed solution was prepared which contained $Ni(NO_3)_2 \cdot 6H_2O$, $Zn(NO_3)_2 \cdot 6H_2O$ and $Fe(NO_3)_3 \cdot 9H_2O$ as metal nitrate in a ratio of 0.008:0.012:0.04 in terms of a raw material molar concentration. While varying the substrate temperature in the range of 250 to 550° C., the raw material mixed solution was intermittently spayed onto the substrate 4 by means of compressed air of 0.01 MPa as a carrier gas in such a manner that a cycle consisting of a 0.5 second spray time and a 1 second stop time was repeated 50 to 600 times, and a Ni—Zn ferrite thin film having a composition of $Ni_{0.4}Zn_{0.6}Fe_2O_4$ was formed on the substrate 4. Samples B1 to B9 each having a thin film formed thereon as described above were measured on film thickness and subjected to tests on magnetic properties to obtain a B—H curve and a coercive field Hc (A/m). Samples B5 and B6 were subjected also to X-ray diffraction to examine their crystal structure. The results obtained are shown in FIGS. 5B1, 5B2, 5B3, 5B4, 6 and 7 and Table 2. FIGS. 5B1, 5B2, 5B3 and 5B4 shows a so-called M—H curve in which a residual magnetic flux B represented by the vertical axis of B—H curve is expressed in an arbitrary unit.

TABLE 2

| Sample No. | Substrate Temperature (° C.) | Number of Spraying (time) | Film Thickness (μm) | Coercive Field Hc (A/m) |
|---|---|---|---|---|
| B1 | 400 | 50 | 1.0 | 130 |
| B2 | 425 | 50 | 0.8 | 130 |
| B3 | 375 | 50 | 1.1 | 135 |
| B4 | 425 | 150 | 1.2 | 180 |
| B5 | 400 | 125 | 1.5 | 120 |
| B6 | 250 | 125 | — | Large |
| B7 | 450 | 600 | 3.3 | 120 |
| B8 | 500 | 500 | 6.3 | 130 |
| B9 | 550 | 500 | — | Large |

The results shown in FIGS. 5B1, 5B2, 5B3 and 5B4 and Table 2 indicate that samples B1 to B5, B7 and B8 obtained by setting the substrate temperature to 300 to 500° C. have a coercive field of 180 A/m or less and have very good soft magnetism with no hysteresis. Sample B8 obtained by repeating the spraying 500 times at a substrate temperature of 500° C. acquired a thin film with a thickness of as large as 6.3 μm and the film formation rate was about 0.1 μm/minute, which was about 10 times the film formation rate by the sputtering method. Sample B6 obtained by setting the substrate temperature to a relatively low temperature of 250° C. shows almost no soft magnetism. Sample B9 obtained by setting the substrate temperature to a relatively high temperature of 550° C. has deposition of powder, thus failing to form a thin film. These indicate that setting the substrate temperature to 300 to 500° C. is very essential for forming a ferrite thin film having good soft magnetism.

Figure 6:
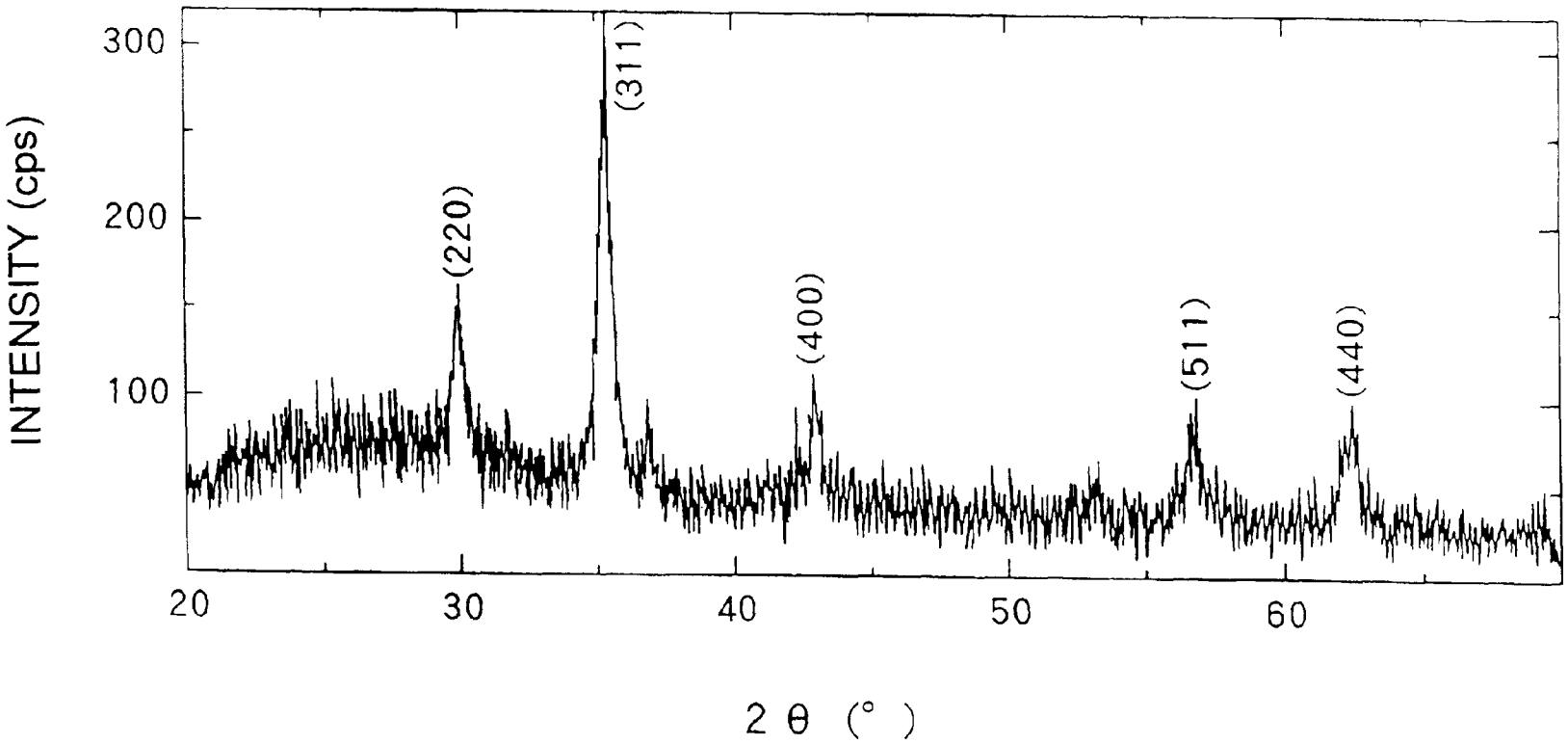
FIG. 6 shows results of X-ray diffraction of the Ni—Zn ferrite thin film of Example 2.
Figure 7:
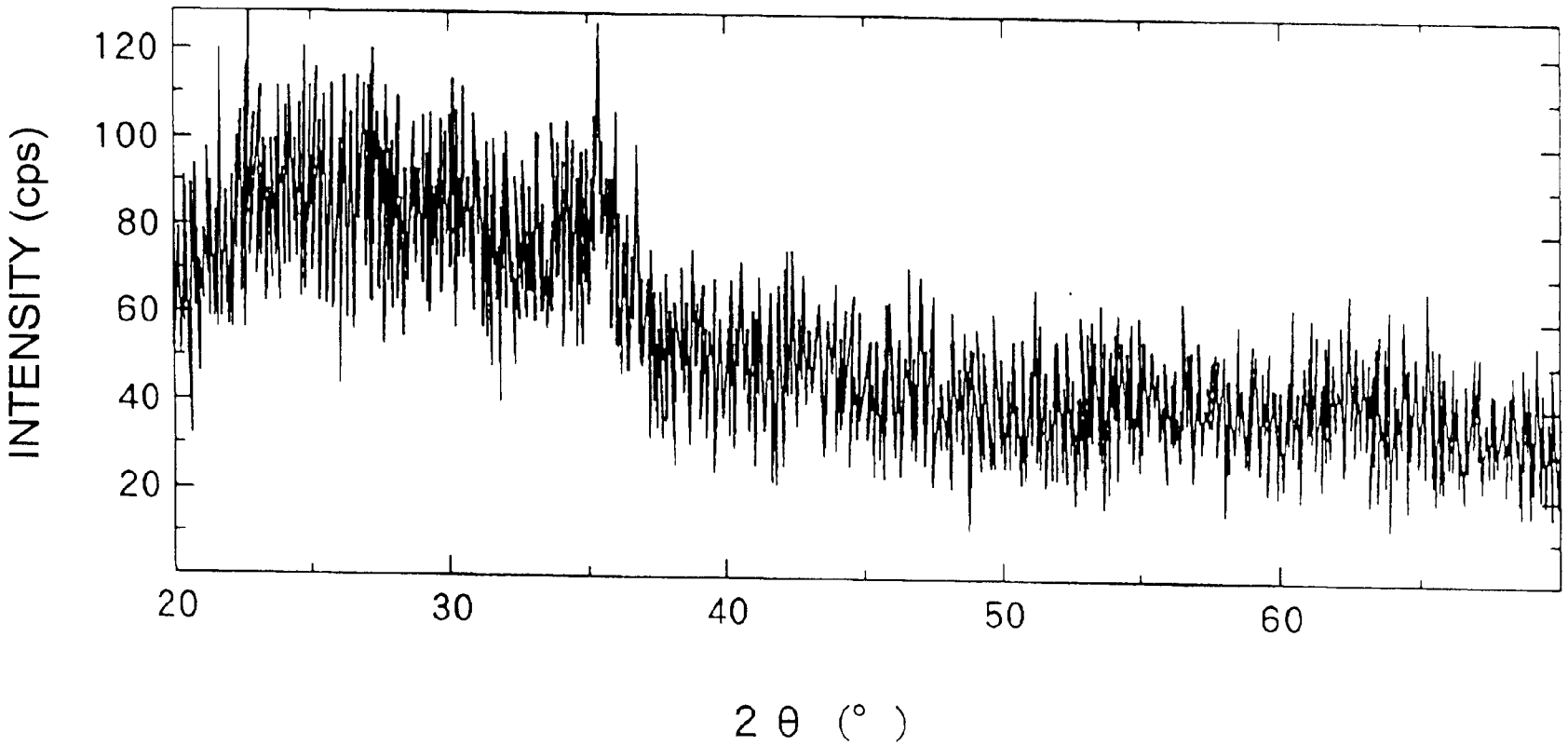
FIG. 7 shows results of X-ray diffraction of the Ni—Zn ferrite thin film of Example 2.

Also, the results of X-ray diffraction shown in FIG. 6 indicate that sample B5 obtained by setting the substrate temperature to 400° C. has a spinel structure, which is a crystal structure of Ni—Zn ferrite, while sample B6 obtained by setting the substrate temperature to 250° C. did not crystallize and has an amorphous structure as indicated in FIG. 7.

In this example, metal nitrate was used as the raw material mixed solution. However, metal alkoxide such as Ni—OR, Zn—OR and Fe—OR (O; oxygen, R; alkyl group) can be used in place of the metal nitrate.

Example 3

The SPD apparatus shown in FIG. 1 was used and the distance from the glass substrate 4 to the nozzle 6*a* was set to 300 mm same as in Example 1. A raw material mixed solution was provided which contained $Ni(NO_3)_2 \cdot 6H_2O$, $Zn(NO_3)_2 \cdot 6H_2O$ and $Fe(NO_3)_3 \cdot 9H_2O$ as metal nitrate in a ratio of 0.008:0.012:0.04 in terms of a raw material molar concentration. While varying the substrate temperature in the range of 250 to 550° C., the raw material mixed solution was intermittently spayed onto the substrate 4 by means of compressed air of 0.01 MPa as a carrier gas in such a manner that a cycle consisting of a 0.5 second spray time and a 1 second stop time was repeated 125 times, and a Ni—Zn ferrite thin film having a composition of $Ni_{0.4}Zn_{0.6}Fe_2O_4$ was formed on the substrate 4.

Samples each having a thin film formed thereon as described above were subjected to tests on magnetic properties to obtain a saturation magnetization Bs and the influence of substrate temperature on the saturation magnetization Bs was examined. The results obtained are shown in FIG. 8, where a saturation magnetization Bs is represented at the vertical axis by an arbitrary unit of Ms.

Figure 8:
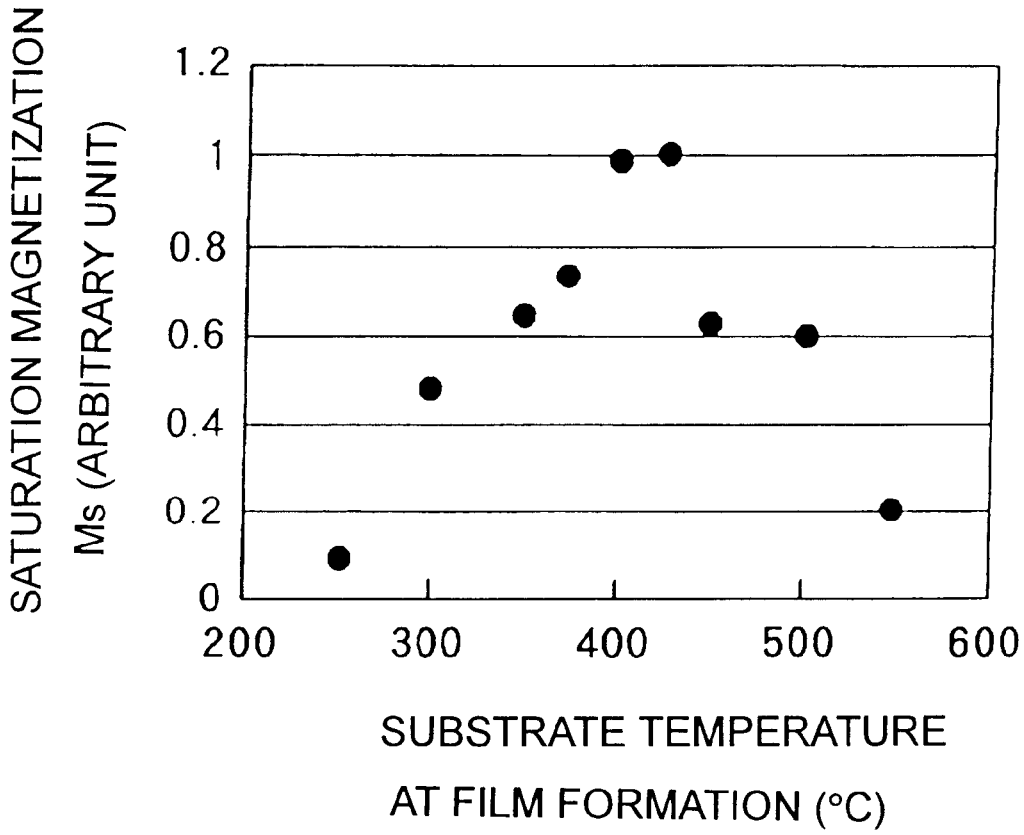
FIG. 8 shows an influence of a substrate temperature on saturation magnetization of a Ni—Zn ferrite thin film of Example 3.

The results shown in FIG. 8 indicate that the saturation magnetization Ms (Bs) of a Ni—Zn ferrite thin film has a peak at a substrate temperature of 400° C. and tends to decrease as the substrate temperature lowers or rises. In particular, the saturation magnetization Ms (Bs) of the thin film formed by setting the substrate temperature at a relatively low temperature of 250° C. or a relatively high temperature of 550° C. was as low as less than 0.2 time the saturation magnetization of the thin film formed by setting the substrate temperature to 400° C. This reveals that setting the substrate temperature to 300 to 500° C. similar to Example 2 above is very essential for forming a ferrite thin film having good magnetic properties.

In this example, metal nitrate was used as the raw material mixed solution. However, metal alkoxide such as Ni—OR, Zn—OR and Fe—OR (O; oxygen, R; alkyl group) can be used in place of the metal nitrate.

Example 4

The SPD apparatus shown in FIG. 1 was used and the distance from the glass substrate 4 to the nozzle 6*a* was set to 300 mm same as in Example 1. Raw material mixed solutions were provided which contained $Ni(NO_3)_2 \cdot 6H_2O$, $Zn(NO_3)_2 \cdot 6H_2O$ and $Fe(NO_3)_3 \cdot 9H_2O$ as metal nitrate in various ion concentration ratios a:b:c (wherein a+b+c=1) of $(Fe)_2$, Zn and Ni, respectively, in a Ni—Zn ferrite thin film to be formed. While keeping the substrate temperature to 400° C., each of the raw material mixed solutions was intermittently spayed onto the substrate 4 by means of compressed air of 0.01 MPa as a carrier gas in such a manner that a cycle consisting of a 0.5 second spray time and a 1 second stop time was repeated 125 times, and a Ni—Zn ferrite thin film having a composition of $Ni_{0.4}Zn_{0.6}Fe_2O_4$ was formed on the substrate 4.

Samples B11 to B26 having a thin film formed thereon as described above were subjected to tests on magnetic properties to obtain a coercive field Hc (A/m). The results obtained are shown in Table 3, and the compositional range in which a good coercive field Hc of 480 A/m or less is obtained is shown in FIG. 9.

TABLE 3

| Sample | Ion Concentration Ratio (a:b:c) | | | Coercive Field Hc |
|---|---|---|---|---|
| No. | a;$(Fe)_2$ | b;Zn | c;Ni | (A/m) |
| B11 | 0.20 | 0.30 | 0.50 | 3500 |
| B12 | 0.30 | 0.32 | 0.38 | 450 |
| B13 | 0.30 | 0.45 | 0.25 | 330 |
| B14 | 0.35 | 0.15 | 0.50 | 2380 |
| B15 | 0.35 | 0.50 | 0.15 | 1470 |
| B16 | 0.40 | 0.30 | 0.30 | 250 |
| B17 | 0.40 | 0.40 | 0.20 | 220 |
| B18 | 0.48 | 0.14 | 0.38 | 430 |
| B19 | 0.50 | 0.30 | 0.20 | 130 |
| B20 | 0.50 | 0.35 | 0.15 | 140 |
| B21 | 0.47 | 0.45 | 0.08 | 240 |
| B22 | 0.60 | 0.20 | 0.20 | 120 |
| B23 | 0.60 | 0.30 | 0.10 | 330 |
| B24 | 0.70 | 0.14 | 0.16 | 440 |
| B25 | 0.70 | 0.22 | 0.08 | 440 |
| B26 | 0.80 | 0.10 | 0.10 | 1430 |

Figure 9:
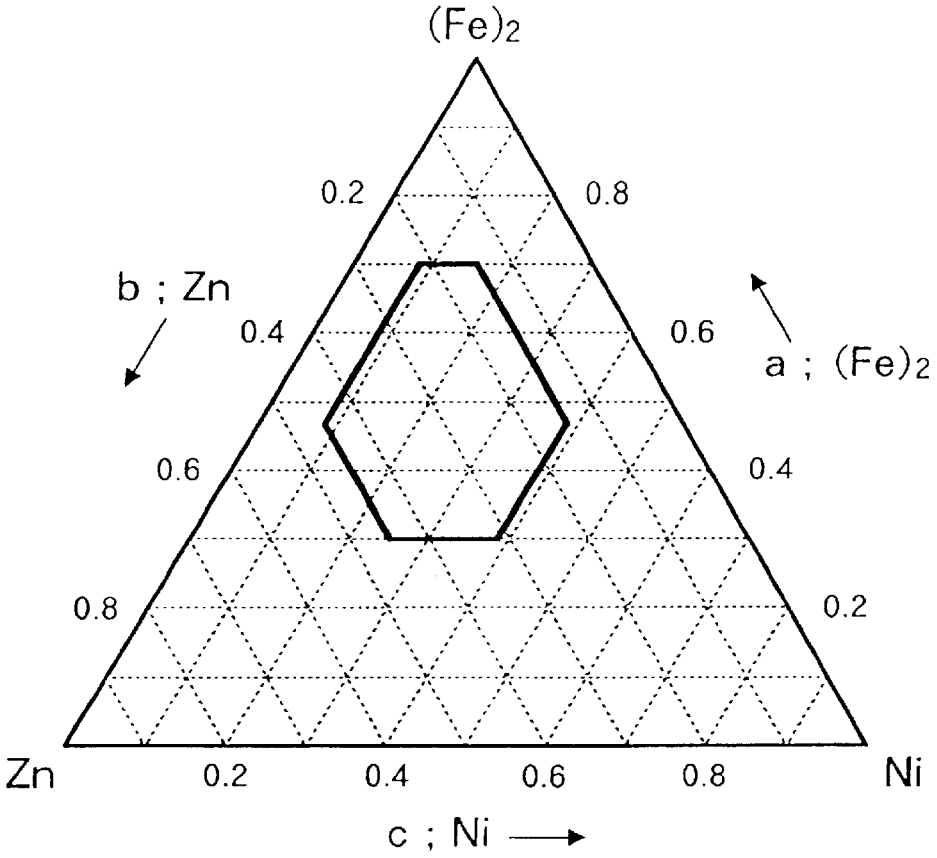
FIG. 9 shows proper ion concentration ranges of $(Fe)_2$, Zn and Ni of a Ni—Zn ferrite thin film of Example 4.

The results shown in Table 3 and FIG. 9 indicate that in order to obtain a good coercive field Hc of 480 A/m or less, it is desirable that metal nitrate, i.e., $Ni(NO_3)_2 \cdot 6H_2O$, $Zn(NO_3)_2 \cdot 6H_2O$ and $Fe(NO_3)_3 \cdot 9H_2O$ be compounded so that ion concentration ratios a:b:c of $(Fe)_2$, Zn and Ni, respectively, in a Ni—Zn ferrite thin film fall within the following ranges:

$$0.30 \leqq a \leqq 0.70,\ 0.14 \leqq b \leqq 0.45, \text{ and } 0.08 \leqq c \leqq 0.38$$

where a+b+c=1.

In this example, metal nitrate was used as the raw material mixed solution. However, metal alkoxide such as Ni—OR, Zn—OR and Fe—OR (O; oxygen, R; alkyl group) can be used in place of the metal nitrate.

Example 5

The SPD apparatus shown in FIG. 1 was used and the distance from the glass substrate 4 to the nozzle 6*a* was set to 300 mm same as in Example 1. A raw material mixed solution was provided which contained $Mn(NO_3)_2 \cdot 6H_2O$, $Zn(NO_3)_2 \cdot 6H_2O$ and $Fe(NO_3)_3 \cdot 9H_2O$ as metal nitrate in a ratio of 0.01:0.01:0.04 in terms of a raw material molar concentration. While varying the substrate temperature in the range of 350 to 500° C., the raw material mixed solution was intermittently spayed onto the substrate 4 by means of compressed air of 0.01 MPa as a carrier gas in such a manner that a cycle consisting of a 0.5 second spray time and a 1 second stop time was repeated 50 to 230 times, and a Mn—Zn ferrite thin film having a composition of $Mn_{0.5}Zn_{0.5}Fe_2O_4$ was formed on the substrate 4.

Figure 10:
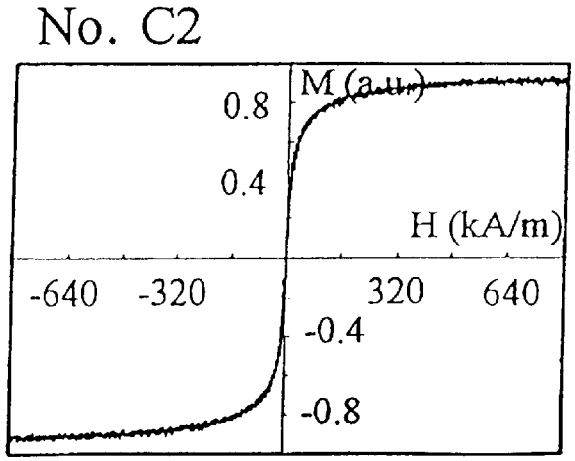
FIG. 10 shows an M—H curve of a Mn—Zn ferrite thin film of Example 5.

Samples C1 to C4 having a thin film formed thereon as described above were measured on film thickness and subjected to tests on magnetic properties to obtain a B—H curve and a coercive field Hc (A/m). The results obtained are shown in FIG. 10 and Table 4. FIG. 10 shows a so-called M—H curve in which a residual magnetic flux B is represented at the vertical axis of B—H curve by an arbitrary unit.

TABLE 4

| Sample No. | Substrate Temperature (° C.) | Number of Spraying (time) | Film Thickness (μm) | Coercive Field Hc (A/m) |
|---|---|---|---|---|
| C1 | 400 | 60 | 1.5 | 130 |
| C2 | 450 | 170 | 1.5 | 130 |
| C3 | 500 | 230 | 1.8 | 135 |
| C4 | 350 | 50 | 1.5 | 130 |

The results shown in FIG. 10 and Table 4 indicate that Samples C1 to C4 have a coercive field Hc of 135 A/m or less and have very good soft magnetism without hysteresis.

In this example, metal nitrate was used as the raw material mixed solution. However, metal alkoxides such as Mn—OR, Zn—OR and Fe—OR (O; oxygen, R; alkyl group) can be used in place of the metal nitrate,

Example 6

The SPD apparatus shown in FIG. 1 was used and the distance from the glass substrate 4 to the nozzle 6*a* was set to 300 mm same as in Example 1. Raw material mixed solutions were provided which contained $Mn(NO_3)_2 \cdot 6H_2O$, $Zn(NO_3)_2 \cdot 6H_2O$ and $Fe(NO_3)_3 \cdot 9H_2O$ as metal nitrates in various ion concentration ratios a:b:c (provided that a+b+c=1) of $(Fe)_2$, Zn and Ni, respectively, in a Mn—Zn ferrite thin film to be formed. While keeping the substrate temperature to 400° C., each of the raw material mixed solutions was intermittently spayed onto the substrate 4 by means of compressed air of 0.01 MPa as a carrier gas in such a manner that a cycle consisting of a 0.5 second spray time and a 1 second stop time was repeated 125 times, and a Mn—Zn ferrite thin film having a composition of $Mn_{0.5}Zn_{0.5}Fe_2O_4$ was formed on the substrate 4.

Samples C11 to C25 having a thin film formed thereon as described above were subjected to tests on magnetic properties to obtain a coercive field Hc (A/m). The results obtained are shown in Table 5, and the compositional range in which a good coercive field Hc of 480 A/m or less is obtained is shown in FIG 11.

TABLE 5

| Sample | Ion Concentration Ratio (a:b:c) | | | Coercive Field Hc |
|---|---|---|---|---|
| No. | a;$(Fe)_2$ | b;Zn | c;Ni | (A/m) |
| C11 | 0.20 | 0.30 | 0.50 | 3500 |
| C12 | 0.30 | 0.10 | 0.60 | 1450 |
| C13 | 0.30 | 0.15 | 0.55 | 330 |
| C14 | 0.30 | 0.38 | 0.32 | 280 |
| C15 | 0.30 | 0.50 | 0.20 | 1470 |
| C16 | 0.40 | 0.20 | 0.40 | 250 |
| C17 | 0.40 | 0.30 | 0.30 | 220 |
| C18 | 0.50 | 0.20 | 0.30 | 130 |
| C19 | 0.50 | 0.25 | 0.25 | 130 |
| C20 | 0.50 | 0.30 | 0.20 | 140 |
| C21 | 0.52 | 0.38 | 0.10 | 240 |
| C22 | 0.60 | 0.20 | 0.20 | 120 |
| C23 | 0.70 | 0.15 | 0.15 | 330 |
| C24 | 0.70 | 0.20 | 0.10 | 440 |
| C25 | 0.80 | 0.10 | 0.10 | 3040 |

Figure 11:
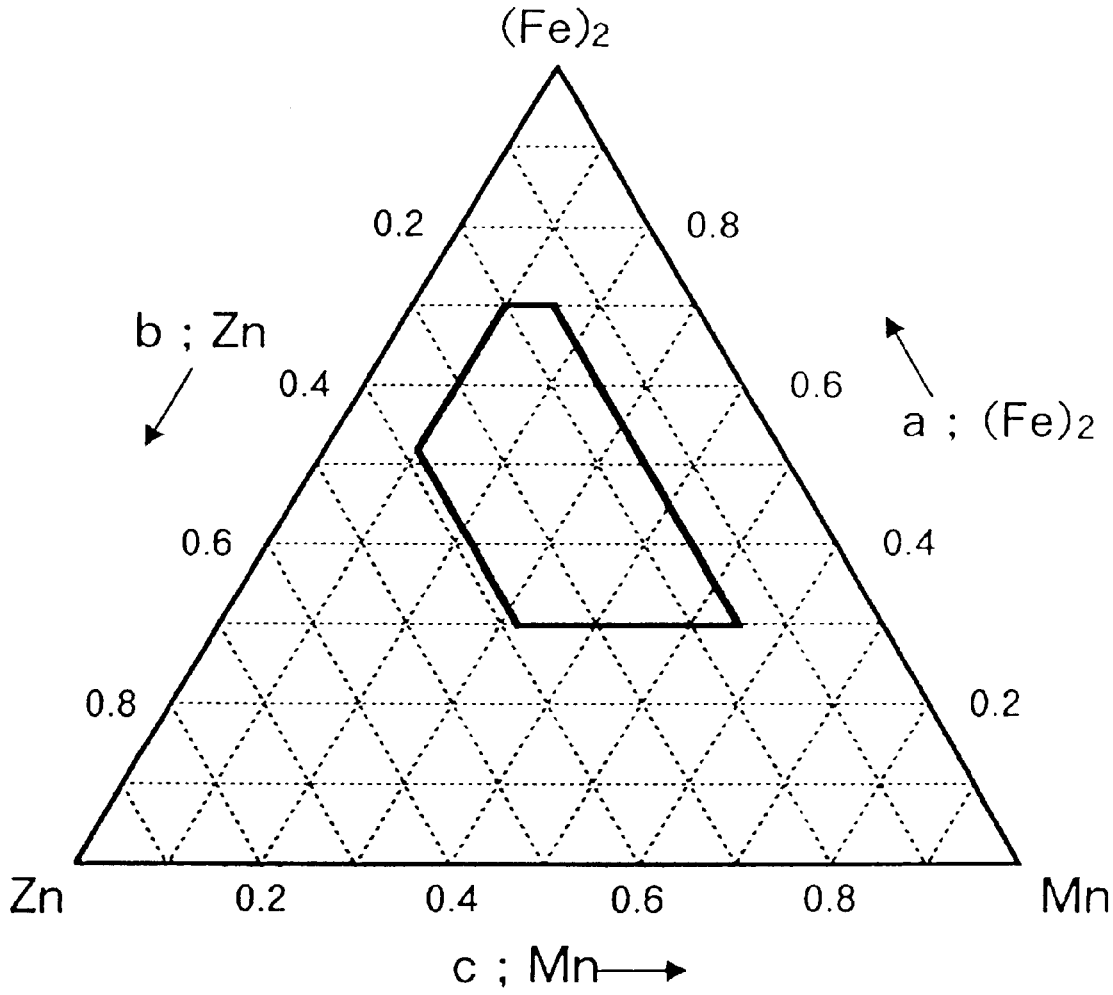
FIG. 11 shows proper ion concentration ranges of $(Fe)_2$, Zn and Ni of a Mn—Zn ferrite thin film of Example 5.

The results shown in Table 5 and FIG. 11 indicate that in order to obtain a good coercive field Hc of 480 A/m or less, it is desirable that metal nitrate, i.e., $Mn(NO_3)_2 \cdot 6H_2O$, $Zn(NO_3)_2 \cdot 6H_2O$ and $Fe(NO_3)_3 \cdot 9H_2O$ be compounded so that ion concentration ratios a:b:c of $(Fe)_2$, Zn and Mn, respectively, in a Mn—Zn ferrite thin film fall within the following ranges:

$$0.30 \leqq a \leqq 0.70,\ 0.15 \leqq b \leqq 0.38, \text{ and } 0.10 \leqq c \leqq 0.55$$

where a+b+c=1.

In this example, metal nitrate was used as the raw material mixed solution. However, metal alkoxides such as Mn—OR, Zn—OR and Fe—OR (O; oxygen, R; alkyl group) can be used in place of the metal nitrate.

As described above, the method of producing a ferrite thin film according to the present invention enables a thin film having a desired thickness to be formed by a simple apparatus in a short time without sacrificing good soft magnetism of a ferrite, thereby greatly contributing to downsizing and weight reduction of electronic devices.

What is claimed is:

1. A method of producing a ferrite thin film, comprising intermittently spraying, by means of a carrier gas, a raw material mixed solution containing nitrate of a constituent metal of a ferrite onto a substrate preheated to a temperature between 350° C. and 500° C.

2. A method of producing a ferrite thin film according to claim 1, wherein a temperature of the substrate is 300 to 500° C.

3. A method of producing a ferrite thin film according to claim 1, wherein the raw material mixed solution is intermittently sprayed onto the substrate.

4. A method of producing a ferrite thin film according to claim 1, wherein the nitrate comprises $Fe(NO_3)_3$ and $Zn(NO_3)_2$.

5. A method of producing a ferrite thin film according to claim 1, wherein the nitrate comprises $Fe(NO_3)_3$ and $Cu(NO_3)_2$.

6. A method of producing a ferrite thin film according to claim 1, wherein the nitrate comprises $Fe(NO_3)_3$, $Zn(NO_3)_2$ and $Ni(NO_3)_2$.

7. A method of producing a ferrite thin film according to claim 6, wherein the nitrate is compounded such that ion concentrations of $(Fe)_2$, Zn and Ni in the ferrite thin film are in the following ranges:

$$0.30 \leqq a \leqq 0.70,\ 0.14 \leqq b \leqq 0.45, \text{ and } 0.08 \leqq c \leqq 0.38$$

where a, b and c are ion concentrations of $(Fe)_2$, Zn and Ni, respectively, and a+b+c=1.

8. A method of producing a ferrite thin film according to claim 1, wherein the nitrate comprises $Fe(NO_3)_3$, $Zn(NO_3)_2$ and $Mn(NO_3)_2$.

9. A method of producing a ferrite thin film according to claim 8, wherein the nitrate is compounded such that ion concentrations of $(Fe)_2$, Zn and Mn in the ferrite thin film are in the following ranges:

$$0.30 \leqq a \leqq 0.70,\ 0.15 \leqq b \leqq 0.38, \text{ and } 0.10 \leqq c \leqq 0.55$$

where a, b and c are ion concentrations of $(Fe)_2$, Zn and Mn, respectively, and a+b+c=1.

10. A method according to claim 1, wherein said substrate is preheated to a temperature between 375° C. and 500° C.

11. A method of producing a ferrite thin film, comprising spraying a raw material mixed solution containing alkoxide of a constituent metal of a ferrite onto a heated substrate by means of a carrier gas.

12.A method of producing a ferrite thin film according to claim 11, wherein a temperature of the substrate is 300 to 500° C.

13. A method of producing a ferrite thin film according to claim 11, wherein the alkoxide comprises an Fe alkoxide and a Zn alkoxide.

14. A method of producing a ferrite thin film according to claim 11, wherein the alkoxide comprises an Fe alkoxide and a Cu alkoxide.

15. A method of producing a ferrite thin film according to claim 11, wherein the alkoxide comprises an Fe alkoxide, a Zn alkoxide and a Ni alkoxide.

16. A method of producing a ferrite thin film according to claim 15, wherein the alkoxide is compounded such that ion concentrations of $(Fe)_2$, Zn and Ni in the ferrite thin film are in the following ranges:

$$0.30 \leqq a \leqq 0.70,\ 0.14 \leqq b \leqq 0.45, \text{ and } 0.08 \leqq c \leqq 0.38$$

where a, b and c are ion concentrations of $(Fe)_2$, Zn and Ni, respectively, and a+b+c=1.

17. A method of producing a ferrite thin film according to claim 11, wherein the alkoxide comprises an Fe alkoxide, a Zn alkoxide and a Mn alkoxide.

18. A method of producing a ferrite thin film according to claim 17, wherein the alkoxide is compounded such that ion concentrations of $(Fe)_2$, Zn and Mn in the ferrite thin film are in the following ranges:

$$0.30 \leqq a \leqq 0.70,\ 0.15 \leqq b \leqq 0.38, \text{ and } 0.10 \leqq c \leqq 0.55$$

where a, b and c are ion concentrations of $(Fe)_2$, Zn and Mn, respectively, and a+b+c=1.

19. A method of producing a ferrite thin film according to claim 11, wherein the raw material mixed solution is intermittently sprayed onto the substrate.

* * * * *

UNITED STATES PATENT AND TRADEMARK OFFICE

CERTIFICATE OF CORRECTION

PATENT NO. : 6,632,473 B2
DATED : October 14, 2003
INVENTOR(S) : Shoji Kaneko et al.

It is certified that error appears in the above-identified patent and that said Letters Patent is hereby corrected as shown below:

Column 11,
Claims 2-3, delete in their entirety.

Signed and Sealed this

Second Day of March, 2004

JON W. DUDAS
*Acting Director of the United States Patent and Trademark Office*